United States Patent [19]

Flueckiger

[11] Patent Number: 4,823,545

[45] Date of Patent: Apr. 25, 1989

[54] METHOD OF AND APPARATUS FOR FALSE-TWIST SPINNING

[75] Inventor: Hans Flueckiger, Oetwil Am See, Switzerland

[73] Assignee: Maschinenfabrik Rieter AG, Winterthur, Switzerland

[21] Appl. No.: 241,001

[22] Filed: Aug. 24, 1988

[30] Foreign Application Priority Data

Aug. 31, 1987 [CH] Switzerland ..... 03333/87

[51] Int. Cl.[4] ..... D01H 5/28; D01H 1/12; D02G 1/04

[52] U.S. Cl. ..... 57/328; 57/5; 57/331; 57/336; 57/339; 57/401

[58] Field of Search ..... 57/5, 6, 328, 400, 401, 57/331, 334, 336, 337–340

[56] References Cited

U.S. PATENT DOCUMENTS

| | | | |
|---|---|---|---|
| 4,183,202 | 1/1980 | Morihashi | 57/328 |
| 4,519,203 | 5/1985 | Schippers | 57/328 |
| 4,524,580 | 6/1985 | Fehrer | 57/401 |
| 4,545,194 | 10/1985 | Juillard | 57/400 |
| 4,565,063 | 1/1986 | Stalder et al. | 57/328 |
| 4,584,830 | 4/1986 | Faure et al. | 57/328 |
| 4,658,574 | 4/1987 | Vignon | 57/328 X |
| 4,660,371 | 4/1987 | Stalder | 57/401 |
| 4,674,274 | 6/1987 | Kato | 57/328 |
| 4,757,680 | 7/1988 | Berger et al. | 57/328 |

FOREIGN PATENT DOCUMENTS

| | | |
|---|---|---|
| 0131170 | 1/1985 | European Pat. Off. . |
| 2620118 | 11/1976 | Fed. Rep. of Germany . |
| 3522657 | 1/1986 | Fed. Rep. of Germany . |
| 3639031 | 5/1987 | Fed. Rep. of Germany . |
| 1198002 | 6/1959 | France . |
| 2480799 | 10/1981 | France . |

OTHER PUBLICATIONS

"Textile Horizons" publication, vol. 36, No. 3, published Mar. 1983, pp. 22 to 24, Warley, West Midlands, Great Britain, article by G. W. Klawonn entitled False-twist: the third generation?.

"Melliand Textilberichte International" publication, vol. 63, No. 3, published Mar. 1982, pp. 175 to 181, Ludwigsburg, Germany, article by J. Lünenschloss et al, entitled Betrachtungen zum OE-Friktionsspinnen.

"Textile Horizons" publication, vol. 36, No. 3, published Mar. 1983, pp. 25 to 27, Warley, West Midlands, Great Britain, article by N. Shindo entitled Murata Lifts Speeds and Denier Range.

*Primary Examiner*—John Petrakes

*Attorney, Agent, or Firm*—Werner W. Kleeman

[57] ABSTRACT

A false-twist spinning unit or apparatus comprises a first spinning disc, such as a top spinning disc and a second spinning disc, such as a bottom spinning disc rotating in opposite directions and arranged in staggered or offset relation at an inter-axis distance from one another such that friction rings thereof form a substantially rhomboid-like crossing surface. Disposed outside the friction rings are suction surfaces which engage the fibers of a sliver delivered from a nip line of an exit roll pair of a sliver feeder and convey such fibers to a yarn core line. The suction surfaces have suction apertures and sucked-off air is transported by suction nozzles coacting with the suction apertures. In operation, at the region of the nip line there is produced a false-twisted yarn core forming a spinning triangle. Edge fibers of the sliver remain outside the spinning triangle and are conveyed by the suction surfaces towards the yarn core line, yet not with the intent of forming a yarn core but for the purpose of being wound around the already formed yarn core. The finished or spun yarn is withdrawn from the false-twist spinning unit by a draw-off roll pair.

26 Claims, 13 Drawing Sheets

Fig.1
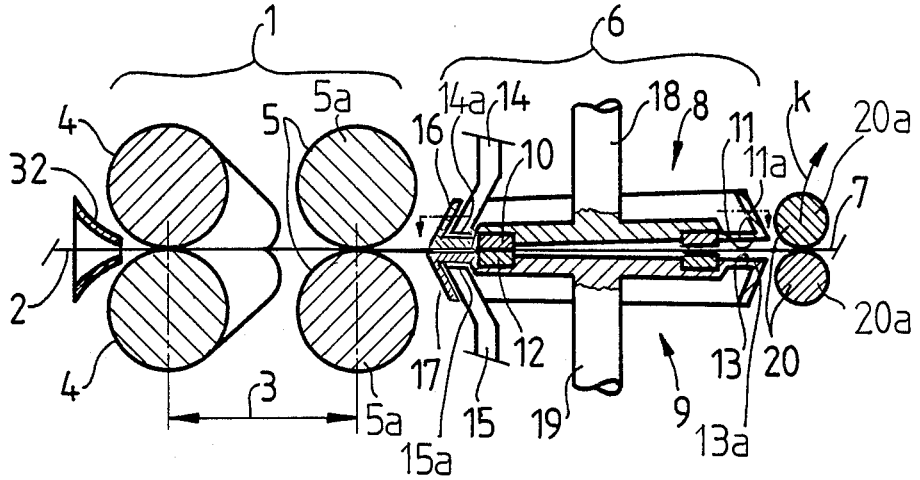
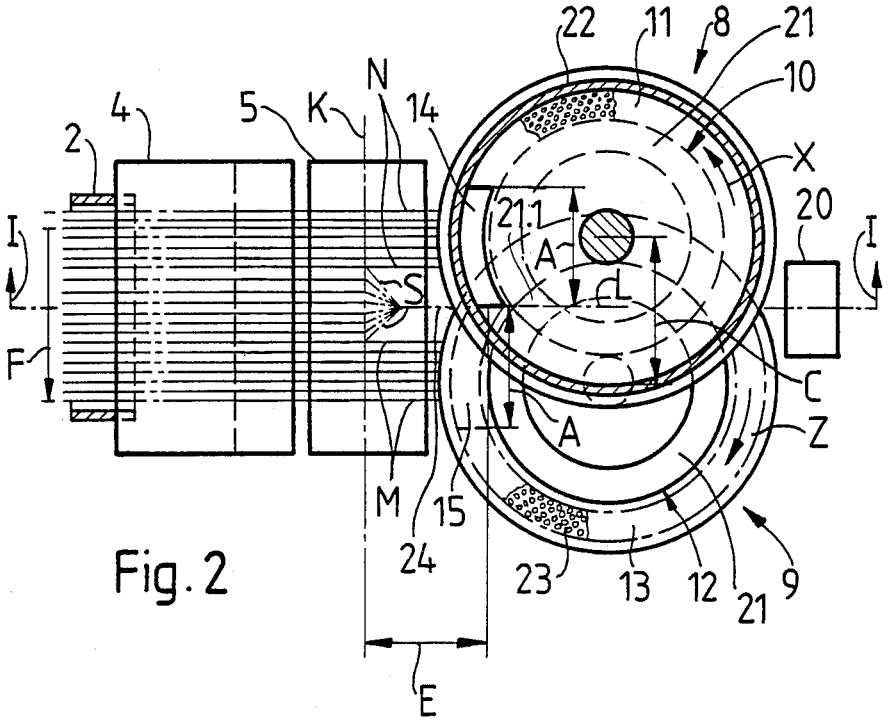
Fig. 2

METHOD OF AND APPARATUS FOR FALSE-TWIST SPINNING

BACKGROUND OF THE INVENTION

The present invention relates to a new and improved method of, and apparatus for, false-twist spinning.

Generally speaking, the apparatus of the present method, is of the type comprising a sliver feed unit or feeder, such as, by way of example, a drafting arrangement or mechanism, which forms a nip line or nip for an outfed sliver and which is operative to deliver the sliver at a predeterminate width from the nip line. There are also provided spinning means which comprise suction means for engaging and conveying or transporting fiber ends of the fibers delivered by the sliver feed unit or feeder and therefore forwarding or conveying the thus engaged fibers. These engaged fiber ends constitute front or leading ends of the sliver as viewed in a predeterminate direction of movement or travel of the sliver from the sliver feed unit or feeder to the spinning means. The spinning means further comprise twisting means for twisting a part or portion of the fibers of the sliver conveyed by the suction means into a false-twisted yarn core. This twisted part or portion of the fibers constitutes an inner part or portion of the delivered fibers of the sliver. Outer parts or portions of the delivered sliver are supplied as so-called edge fibers by the suction means to the false-twisted yarn core for winding around the false-twisted yarn core with a pitch or helix angle which is steeper than the pitch or helix angle of the fibers of the false-twisted yarn core. Also provided are means for drawing-off or withdrawing the finished or spun yarn.

Various false-twist spinning methods or processes for producing a yarn are known in the textile arts, wherein the yarn core has the core fibers in an untwisted state and the wrapping fibers for holding the untwisted fibers together are wound therearound. Both the untwisted yarn core fibers and the wrapping fibers are staple fibers which are usually delivered by a drafting arrangement or mechanism.

A false-twist spinning method as known from German Pat. No. 2,620,118, published Nov. 18, 1976 and U.S. Pat. No. 4,183,202, granted Jan. 15, 1980, employs a false twisting nozzle and an untwisting nozzle. A sliver delivered by a drafting arrangement is divided into core fibers and edge fibers. The core fibers are false-twisted by the false twisting nozzle, which is the second nozzle as seen or considered in the direction of yarn movement, whereas the edge fibers which contact the false-twisted core are twisted by the first untwisting nozzle, again as seen or considered in the direction of yarn movement, around the false-twisted core in an opposite direction of rotation. As the false-twisted yarn core untwists, the edge fibers become looped or wound even more tightly around the yarn core in the form of wrapping or coiling fibers. Consequently, there can arise what are known as corkscrew effects in the spun yarn which can impart a certain stiffness thereto, and thus, a boardy texture or hard handle to the cloth or fabric produced from such yarn.

European Published patent application No. 0,131,170, published Jan. 16, 1985, and the essentially cognate U.S. Pat. No. 4,565,063, granted Jan. 21, 1986, discloses further prior art for fabrication of false-twist spun yarns. In this prior art method only a single twisting nozzle is used, namely the nozzle for false twisting the yarn core.

A special feature of this method is that the distance between, on the one hand, the place where the edge fibers are brought into engagement with the false-twisted yarn core and, on the other hand, the nip line of the exit roll pair is such that the edge fibers are wound around the yarn core as long as their rear or trailing ends remain clamped in the nip of the exit roll pair. Consequently, the end of the individual edge fiber is wound into the so-called spinning triangle while the edge fibers are twisted around the yarn core in the direction of rotation thereof but at a much steeper pitch or helix angle, so that when the yarn core untwists into a position in which the core fibers are parallel, the edge fibers are twisted through a neutral position, in which they extend parallel to the direction of yarn conveyance, and then in an opposite twist direction. In other words, the edge fibers, if they had an S-twist before the untwisting of the yarn core, then would have a Z-twist in the finished yarn.

With this prior art technique, the edge fibers are therefore wound sufficiently tightly around the yarn core but not so tightly as to cause marked or pronounced corkscrew effects.

The disadvantage of all systems using compressed air or pneumatic twisting nozzles resides in the limitation of the speed of rotation of the air vortex or eddy by the speed of sound in air, and, therefore, of the yarn core in the twisting nozzle.

Consequently, in another known method as disclosed in German Published patent application No. 3,639,031 A1, published May 21, 1987 and the cognate U.S. Pat. No. 4,674,274, granted June 23, 1987, the edge fiber coiling nozzle was combined with a belt twister in the form of two driven crossed friction belts.

This solution of the problem obviates restriction on the twist which can be imparted to the false-twisted yarn core but does not obviate the problem of severe corkscrewing and the disadvantage of fiber guidance from the nip line or region of the drafting arrangement up to and including the belt twister.

SUMMARY OF THE INVENTION

Therefore with the foregoing in mind it is a primary object of the present invention to provide a new and improved method of, and apparatus for, false-twist spinning which is not afflicted with the aforementioned drawbacks and shortcomings of the prior art.

Another and more specific object of the present invention aims at providing a false-twist spinning method and apparatus for the performance thereof, which affords the technological advantages of the method disclosed in the aforementioned European Published patent application No. 0,131,170, and U.S. Pat. No. 4,565,063 and which still obviates the disadvantages limiting the production or output rate.

Still a further notable object of the present invention aims at the provision of a new and improved method of, and apparatus for, false-twist spinning of a yarn in a manner affording the possibility of increasing the spinning speed beyond that which can be realized by compressed air false twisters while attaining good yarn properties or characteristics.

Yet a further significant object of the present invention aims at providing a new and improved method of, and apparatus for, false-twist spinning which is relatively simple in construction and design, extremely economical to manufacture, highly reliable in operation, not readily subject to breakdown or malfunction and requires a minimum of maintenance and servicing.

Now in order to implement these and still further objects of the present invention which will become more readily apparent as the description proceeds, the false-twist spinning method of the present development, among other things, is manifested by the features that, a fiber sliver is delivered in a predeterminate sliver width from a sliver feeder having a pair of exit rolls forming a nip line for movement of the fiber sliver in a predetermined direction of conveyance or movement. Suction means engage ends of the fibers of the fiber sliver which constitute front fiber ends, as viewed in the predetermined direction of conveyance of the fiber sliver. The aforenoted engagement by the suction means of the ends of the fibers of the fiber sliver entails moving two suction surfaces of the suction means in opposite directions for suctionly engaging predominantly all of the fibers of the fiber sliver and conveying on the suction surfaces the thus suctionly engaged fibers towards one another for commingling the suctionly engaged fibers with one another and for conveyance of the suctionly engaged fibers in such predetermined direction of conveyance. An inner portion of the engaged fibers is supplied to fiber twisting means coacting with the suction means and where there is formed a false-twisted yarn core from the inner portion of the engaged fibers which are wound or twisted at predeterminate pitch. At least outer portions of the fiber sliver are supplied by the suction means as edge fibers to the false-twisted yarn core such that the edge fibers are wound or . twisted or coiled by the fiber twisting means around the false-twisted yarn core with a pitch steeper than the pitch of the false-twisted yarn core, that is to say, the fibers forming the same, in order to produce a yarn travelling in a predetermined direction of movement. There is selected a distance between the nip line of the exit rolls of the sliver feeder and an imaginary predeterminate intersection or crossing of the suction surfaces so as to be in such a relationship to the average fiber length of the fibers of the fiber sliver that the twisted yarn core engages the edge fibers at their front ends as long as rear ends thereof remain clamped in the nip line, so that the edge fibers leave the nip line only after the edge fibers have been twisted around the yarn core and are engaged by a spinning triangle formed by the inner portion of the engaged fibers twisted to form the false-twisted yarn core.

As indicated previously, the present invention is not only concerned with the aforementioned method aspects but also pertains to an improved false-twist spinning apparatus or unit for the reliable and effective practice of the inventive method. To that end, the false-twist spinning apparatus or unit, among other things, is manifested by the features that, the suction means comprise two perforate suction surfaces arranged such as to be disposed opposite one another, move towards one another and overlap one another. The twisting means comprise two friction surfaces. A suction surface and a friction surface are disposed one beside the other or in adjacent of juxtaposed relationship and travel in the same direction as one another. At least at the region or side of the silver feed unit or feeder, the suction surface is disposed upstream or before the adjacent friction surface as viewed or considered in the predeterminate direction of yarn conveyance or movement.

Certain of the more notable advantages provided by the present invention reside in the possibility of increasing spinning speed beyond that which can be achieved with compressed air or pneumatic false twisters while attaining good yarn properties or characteristics.

BRIEF DESCRIPTION OF THE DRAWINGS

The invention Will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a schematic cross-sectional view through an exemplary embodiment of false-twist spinning apparatus or unit according to the invention and taken substantially along the line I—I of FIG. 2;

FIG. 2 is a schematic top plan view of the exemplary embodiment of false-twist spinning apparatus of FIG. 1;

DETAILED DESCRIPTION OF THE PREFERRED EMBODIMENTS

Describing now the drawings, it is to be understood that in order to simplify the illustration thereof only enough of the construction and details of the exemplary embodiments of false-twist spinning apparatuses or units have been depicted as needed for those skilled in the art to readily understand the underlying principles and concepts of the present invention.

Figure 3:
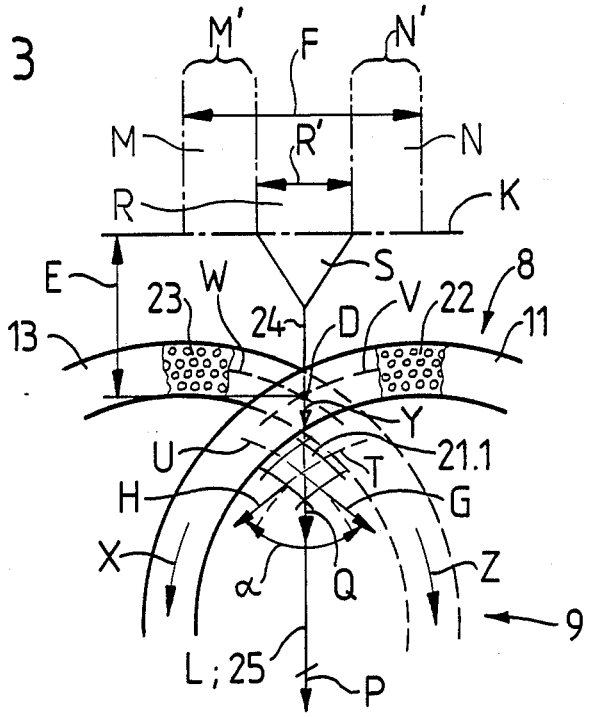
FIG. 3 schematically illustrates details of the false-twist spinning apparatus depicted in FIG. 2.

Turning attention now initially to the exemplary embodiment of false-twist spinning apparatus or unit as depicted in FIGS. 1 to 3 of the drawings, it is to be understood that at the inlet side of a drafting arrangement or mechanism 1 operative as a sliver feed unit or feeder, a fiber sliver 2 or other suitable supply of fiber or fibrous material is brought to a predetermined or predeterminate sliver or fiber material width F in a condenser 32. Then the fiber sliver or sliver 2 is drafted in a main drafting zone 3 between a suitable pair of apron rolls 4 and a pair of exit or delivery rolls 5. The fiber sliver 2 is subsequently formed into a spun yarn 7 in a false-twist spinning apparatus or unit 6. It is here mentioned that apart from the drafting arrangement or mechanism 1 there could be also used as a further possible sliver feed unit or feeder a suitable sliver or fiber material source such as a sliver can, containing a drafted sliver or fiber sliver which is then fed to a suitable condenser, like the condenser 32 and subsequently delivered to a pair of coacting rolls, like the exit or delivery roll pair 5 from which location the thus processed fiber sliver is then delivered to the associated false-twist spinning unit or apparatus.

There has only been conveniently shown that part of the drafting arrangement or mechanism 1 where there is located the main drafting zone 3; the drafting arrangement or mechanism 1 may also comprise a sliver condenser (not shown) and an entry zone (not shown).

The false-twist spinning apparatus or unit 6 comprises, as seen when looking at FIG. 1, a first, here an upper or top rotatable spinning disc or disc member 8 and a second, here a lower or bottom rotatable spinning disc or disc member 9. At this point it is, however, remarked that the employed terms "upper or top" and "lower or bottom" or equivalent expressions, are not intended to be used in any limiting sense but only with reference to the manner in which the position of the spinning discs 8 and 9 happens to be shown in FIG. 1. In any event, the spinning disc 8 is driven to rotate about an axis of rotation thereof by means a drive shaft 18 and the other spinning disc 9 is likewise driven to rotate about an axis of rotation thereof by a drive shaft 19. The drive shafts 18 and 19 are driven by any suitable and therefore non-illustrated drive means in order to appropriately drive the spinning discs 8 and 9, for instance, in the directions of rotation X and Z, respectively, which are opposite to one another. As will be readily understood, these drive shafts 18 and 19 rotate in associated mountings or bearings, which structure is conventional and therefore has not here been further shown.

It is here additionally noted that the elements receiving the drive shafts 18 and 19 can be so structured that at least one of the spinning discs 8 or 9 can be disengaged from the other spinning disc 9 or 8 to enable the disc surfaces which are located opposite one another in partially overlying or overlapping relation to be cleaned as necessary or when desired.

The rotatable spinning disc or disc member 8 comprises a friction ring or ring portion 10 and an adjacently situated suction ring or ring portion 11*a* which has a suction surface 11. The other rotatable spinning disc or disc member 9 comprises a friction ring or ring portion 12 and an adjacently situated suction ring or ring portion 13*a* which has a suction surface 13. Each of the friction rings 10 and 12 have a related or associated annular or ring-shaped friction surface 21, as best recognized by referring to FIG. 2. The friction surfaces 21 are somewhat raised or protruding in relation to the suction surfaces 11 and 13 to form a step-like transition.

These suction surfaces 11 and 13 are also annular or ring-shaped. There have been only conveniently shown in FIG. 2 part of the apertures or openings 22 and 23 which are provided at the suction surfaces 11 and 13 of the respective rotatable spinning discs 8 and 9 of the embodiment of FIGS. 1 to 3 and which apertures or openings 22 and 23 are equally provided for the modified embodiments of FIGS. 12, 13 and 14, 15, and 16.

As will be recognized by inspecting FIG. 1, in order to suck air through these apertures or openings 22 and 23 a suction nozzle or element 14 or equivalent suction means is operatively associated with the top or upper spinning disc 8 and a suction nozzle or element 15 or equivalent suction means is operatively associated with the bottom or lower spinning disc 9 at the respective suction surfaces 11 and 13. The elements or components to which the suction nozzles 14 and 15 are secured have not been particularly shown to simplify the illustration, but it is noted, for instance, that these suction nozzles 14 and 15 each could be secured to the associated element or component operative to receive the bearings and the drive for the drive shafts 18 and 19, respectively.

Continuing, the air inlets 14*a* and 15*a* of the suction nozzles or suction elements 14 and 15 extend near to that is to say, at a spacing of from about 0.1 to 0.3 mm with respect to—the confronting surface of the spinning discs 8 and 9 and each such confronting surface is located on the opposite side to that spinning disc side where the suction surfaces 11 and 13 are disposed, but without making contact with such confronting disc surfaces, in order to reduce as far as possible the size of the inlets or inflow regions through which there can inflow false or secondary air.

Each of the rotatable spinning discs or disc members 8 and 9 also are provided with a covering wall or cover or enclosure member 16 and 17, respectively, and behind which there is located, in each case, the associated suction nozzle 14 and 15, respectively.

Figure 17A:
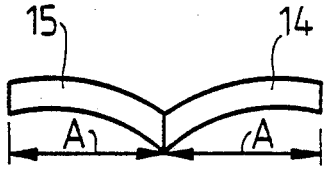
FIGS. 17*a* to 17*c* and 18*a* to 18*c* respectively illustrate in diagrammatic form two possible modifications of the exemplary embodiments of false-twist spinning apparatuses or units shown in FIGS. 1 to 3, 9 to 10*a*, 12, 13 to 14 and 15, respectively.
Figure 17B:
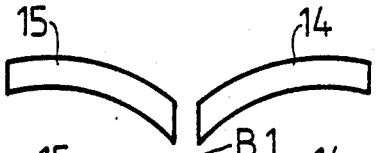
Figure 17C:
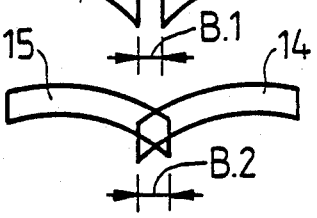

As can be gathered from FIG. 2, the suction nozzles 14 and 15 are each of a predetermined width A. As can be recognized from the illustrations of FIGS. 17*a* to 17*c* depicting various possible arrangements of the suction nozzles 14 and 15, these suction nozzles 14 and 15, when considered in plan view as in the showing of FIG. 2, can be disposed such that they are either contiguous with respect to one another, as depicted in FIG. 17*a* or spaced or separated from one another by a distance or spacing B.1, as depicted in FIG. 17*b* or else can be positioned so to overlap one another by an amount B.2, as depicted in FIG. 17*c*. The significance of these three exemplary variants of possibly positioning the suction nozzles 14 and 15 or the like, in relation to one another will be described in greater detail hereinafter in connection with the description of the operation of the inventive false-twist spinning apparatuses or units.

As also can be seen particularly well by further inspecting FIG. 2, the two rotatable spinning discs or disc members 8 and 9 are not disposed coaxially of one another, rather are offset or staggered from one another by an inter-axis distance or spacing C constituting the spacing between the axes of rotation of these rotatable spinning discs or disc members 8 and 9. Additionally, and as can be further seen in FIG. 1, these coacting spinning rotatable discs 8 and 9 diverge or open away from one another so that, as can be gathered from an inspection of both FIGS. 1 and 2, just one defined overlap area or region, here, for instance, a substantially rhomboid-like overlap area or region 21.1 is formed relatively near the nip line or nip K of the exit or delivery roll pair 5 and defines a contact zone or region between the friction surfaces 21 of the two friction rings 10 and 12.

In operation, the drafting arrangement or mechanism 1 is so adjusted or set by means of known fiber-guiding or fiber sliver or sliver 2 is delivered at a substantially predeterminate width F from the nip line or nip K formed by the exit or delivery roll pair 5 defined by the rolls or rollers 5*a*, so that, and as shown in FIGS. 2 to 6, in the spinning process the fiber sliver or sliver 2 is subdivided into edge or peripheral or marginal fibers M and N and into the therebetween disposed intermediate fibers R of a predeterminate width R′ which lead or extend to a so-called spinning triangle S whose width likewise is conveniently denoted by such reference character R′. It is here remarked that the width F of the drafted fiber sliver 2 may be advantageously greater by 10% to 30% than the width R′ of the spinning triangle S. As to the subdivision of the sliver 2 such arises as follows:

At the start of spinning, the sliver fibers delivered from the afore-discussed nip line or nip K of the exit or delivery roll pair 5 are sucked between the spinning discs 8 and 9 by the suction or vacuum action produced by the suction surfaces 11 and 13. These sucked-in sliver fibers are conveyed or transported towards a yarn core line L where the sliver fibers, emanating from the two directions of conveyance governed by the directions of rotation X and Z of the rotatable spinning discs 8 and 9, meet one another and some of these fibers, while twisting or coiling around one another, form a primary false-twisted yarn core 24. To ensure that the fibers meet in this way, the suction nozzles 14 and 15 are positioned as previously described. It is here mentioned that start-of-spinning or spinning conditions during yarn or thread production, do not differ greatly whether the suction nozzles 14 and 15, looking in plan view as in FIG. 2, are contiguous with one another as in the showing of FIG. 17*a*, or spaced at a distance B.1 from one another as in FIG. 17*b* (in tests such distance or spacing amounted to about 4 mm), or overlap one another by an amount B.2 as in FIG. 17*c* (in tests such overlap amounted to about 4 mm).

The suction surfaces 11 and 13, which rotate in opposite directions—i.e., the rotational directions X and Z, respectively—impart to this primary false-twisted or twisted yarn core 24 a common force component Y in the direction P of yarn conveyance or movement, and thus, the primary twisted yarn core 24 is automatically conveyed or transported towards and engaged by the overlap area or region 21.1. This common force component Y is shown diagrammatically in FIG. 3, and without any mention of an effective force, will be seen to start from an imaginary intersection or crossing point D of the center lines V and W of the suction surfaces 11 and 13, respectively.

Engagement of the false-twisted yarn core 24 by the overlap area or region 21.1 leads to tighter twisting of the fibers in the false-twisted yarn core 24 which is rotated and again to conveyance or movement of the false-twisted yarn core 24 in the yarn movement direction P.

The conveying effect of the overlap area or region 21.1 in the yarn movement direction P must be such as to produce adequate tension in the false-twisted yarn, for it is such tension which determines the width R′ of the spinning triangle; it is here remarked the term "conveying effect" denotes a combination of conveying force and conveying speed. The conveying effect in the yarn movement direction P depends not only upon the friction between the false-twisted yarn core 24 and the overlap area or region 21.1 but also upon the angular velocity of the friction rings 10 and 12 and the inter-axis distance or spacing C between the offset spinning discs 8 and 9. The angular velocity is representatively shown or expressed in FIG. 3 diagrammatically, and without denoting actual values, in the form of vectors G and H which start from the imaginary point of intersection or crossing of the center lines U and T of the friction rings 10 and 12, the common vector Q which extends in the direction P of yarn conveyance or movement depending upon the afore-mentioned inter-axis distance C and the angular velocity.

The spinning triangle width R′ and total sliver width F determine the width, generally indicated in FIG. 3 by the reference numerals M′ and N′, of the edge or peripheral fibers M and N, respectively, which are also taken over or engaged by the suction surfaces 11 and 13, respectively. However, since these edge fibers M and N are further away from the yarn core line L than the core-forming fibers, these edge fibers M and N are not incorporated as fibers of the false-twisted yarn core 24 but are engaged by the rotating yarn core 24 and wound therearound.

The basic idea is here that the fibers relatively near the center are twisted to form a yarn core 24 before the edge fibers M and N reach the yarn core line L so that so-to-speak their "use" is "merely" as wrapping or coiling fibers.

Figure 4:
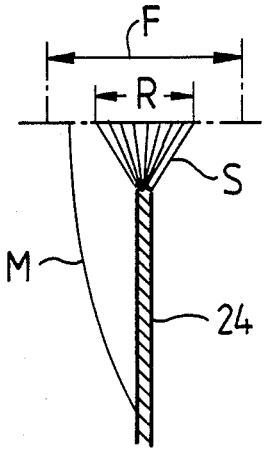
FIGS. 4 to 6 each are schematic views depicting various steps which occur in the inventive method of false-twist spinning a yarn, as, for instance, with the embodiment of spinning apparatus depicted in FIGS. 1 to 3.
Figure 5:
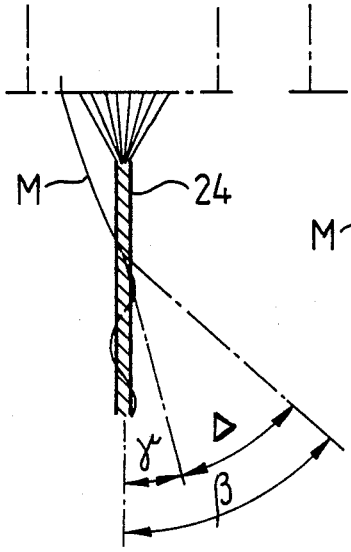
Figure 6:
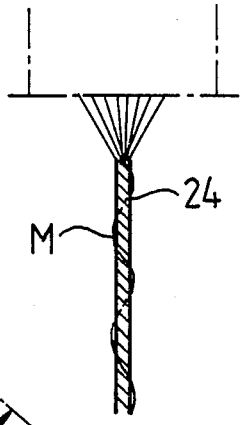
Figure 7:
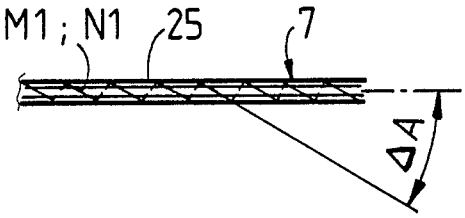
FIG. 7 is a schematic view of the finished or spun yarn produced when practicing the inventive methods of false-twist spinning a yarn.

The fiber coiling or wrapping process is illustrated in FIGS. 4 to 6 and the finished or spun yarn in FIG. 7.

As already stated, a so-called false-twisted yarn core 24 which extends between the overlap area or region 21.1 and the spinning triangle S arises between the friction rings 10 and 12 near the overlap area or region 21.1.

As was also previously mentioned, in addition to the intermediate fibers or fiber portion R which are delivered for the formation of the false-twisted yarn core 24, fibers or fiber portions are also delivered from corresponding zones or regions of the suction surfaces 11 and 13 to furnish the edge or peripheral fibers M and N which are then wrapped or coiled around the false-twisted yarn core 24. This wrapping or coiling proceeds as follows:

After the front or leading end of the edge fibers M and N (for the sake of simplicity just a single fiber from the corresponding zone serving for delivery of such fibers M is shown in FIGS. 4 to 6 at the left-hand side thereof) has been engaged by the rotating yarn core 24, and assuming that the rear or trailing end of the engaged fiber is still being guided in the nip line or nip K, this edge fiber is then wound or twisted around the yarn core 24 in the same direction of rotation, i.e. if the yarn core 24 has a S-twist, so does the wrapping or coiling fiber but at a considerably larger pitch or helix angle $\gamma$. However, the angle $\gamma$ can increase towards the spinning triangle S and shortly before such location may correspond to the angle $\beta$.

The reason for this increased pitch of the angle $\gamma$ is due to the fiber which is to be wrapped or coiled moving or migrating faster than the conveyance or forwarding of the yarn core 24 and in a direction opposite to the yarn movement direction P—i.e., towards the spinning triangle S—and, assuming that the rear or trailing end of the fiber is still being clamped at the nip line or nip K, the increased pitch or helix ensures that such fiber end is twisted into the spinning triangle S so that the rear fiber end subsequently released from the nip line or nip K remains engaged in the yarn core 24 of the finished or spun yarn 7. The pitch or helix angle $\gamma$ therefore increases as the fiber wrapping moves faster.

To ensure that the rear or trailing end of the fiber to be wrapped or coiled is wound into the spinning triangle S, the distance or spacing E between the overlap or crossing zone (shown in FIGS. 17*a* to 17*c*) of the suction surfaces 11 and 13, shown concentrated or represented as a single point coinciding with the imaginary intersection or intersection or crossing point D of the center lines V and W of the suction surfaces 11 and 13, and the nip line or nip K, must be smaller than the length of the edge or peripheral fibers M and N. Premature winding of the front end of the wrapping or coiling fibers M and N into the spinning triangle S may so shorten the wrapping length of each of the edge fibers that the wrapping strength given by the adhesion length of the wrapping fiber is insufficient to ensure adequate tearing strength of the finished or spun yarn 7.

The finished or spun yarn 7, which is shown in FIG. 7 and which is further conveyed or forwarded by the yarn draw-off or withdrawal roll pair 20 containing the draw-off or withdrawal rolls 20*a* disposed after or downstream of the false-twist spinning apparatus or unit 6, comprises a substantially untwisted yarn core 25 held together by the edge or peripheral fibers M and N which have wrapped or coiled thereabout and which will now be generally called wrapping or coiling fibers M1 and N1 in the description to follow.

The pitch or helix $\Delta A$ (FIG. 7) of the wrapping fibers M1 and N1 basically corresponds to the pitch difference $\Delta$ (FIG. 5) resulting from the difference between the pitch $\beta$ of the false-twisted yarn core 24 and the pitch $\gamma$ of the edge fibers M and N. However, the direction of wrapping or coiling of the wrapping fibers M1 and N1 is opposite to that of the edge fibers M and N, that is to say, when the edge fibers M and N have a S-direction, the wrapping fibers have a Z-direction. During untwisting, the coiled fibers have, over some of their length and for a short moment of time, a position which is essentially parallel to the longitudinal or lengthwise axis of the false-twisted yarn core 24 until, as this yarn core 24 further untwists, the coiled fibers gradually assume the opposite coiling or wrapping direction.

Some fibers of the sliver 2 which forms the spinning triangle S may not be present therein upon departure from the nip line or nip K if, for example, the force of adhesion between such fibers and the exit or delivery rolls 5*a* of the exit roll pair 5 is greater than the force of adhesion with the other fibers forming the spinning triangle S. Missed fibers of this kind, just like the edge fibers M and N, remain free at their front or leading ends until, like the edge fibers M and N, they are engaged by the rotating yarn core 24 and also form coiling or wrapping fibers.

Figure 8:
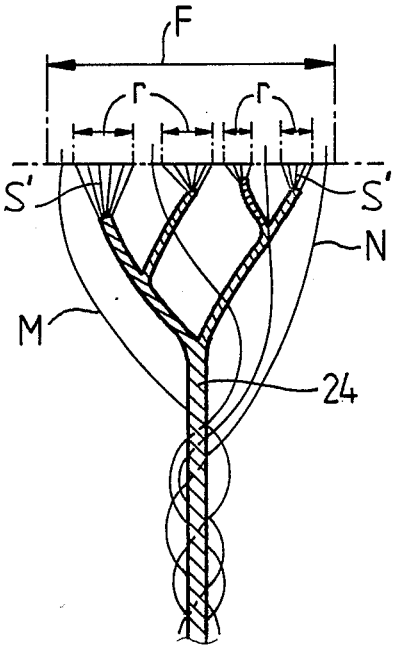
FIG. 8 shows a variant of the method shown in FIGS. 4 to 6.

Additionally, and as indicated in FIG. 8, it is here noted that it has been found that the spinning triangle S repeatedly invariably divides into smaller spinning triangles S' of different width r, so that the edge or marginal fibers M and N not only appear in the edge regions or zones, as such has been depicted in FIGS. 4 and 5, rather the edge fibers M and N can be distributively formed externally of and between the individual small spinning triangles S'.

Figure 9:
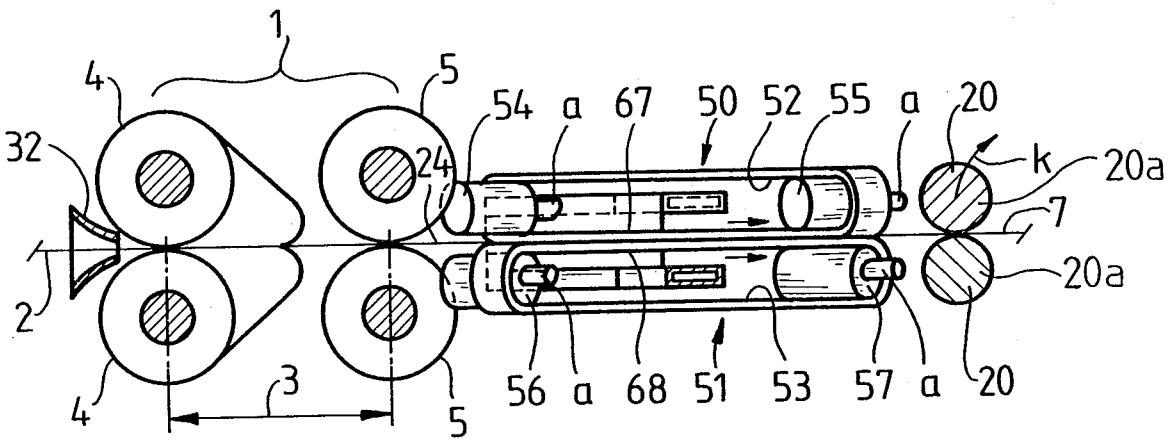
FIG. 9 is a schematic side elevational view, partly in section, taken substantially in the direction of the arrow II of FIG. 10 depicting a variant embodiment of false-twist spinning apparatus or unit in the form of a bell twister constructed according to the invention.
Figure 10:
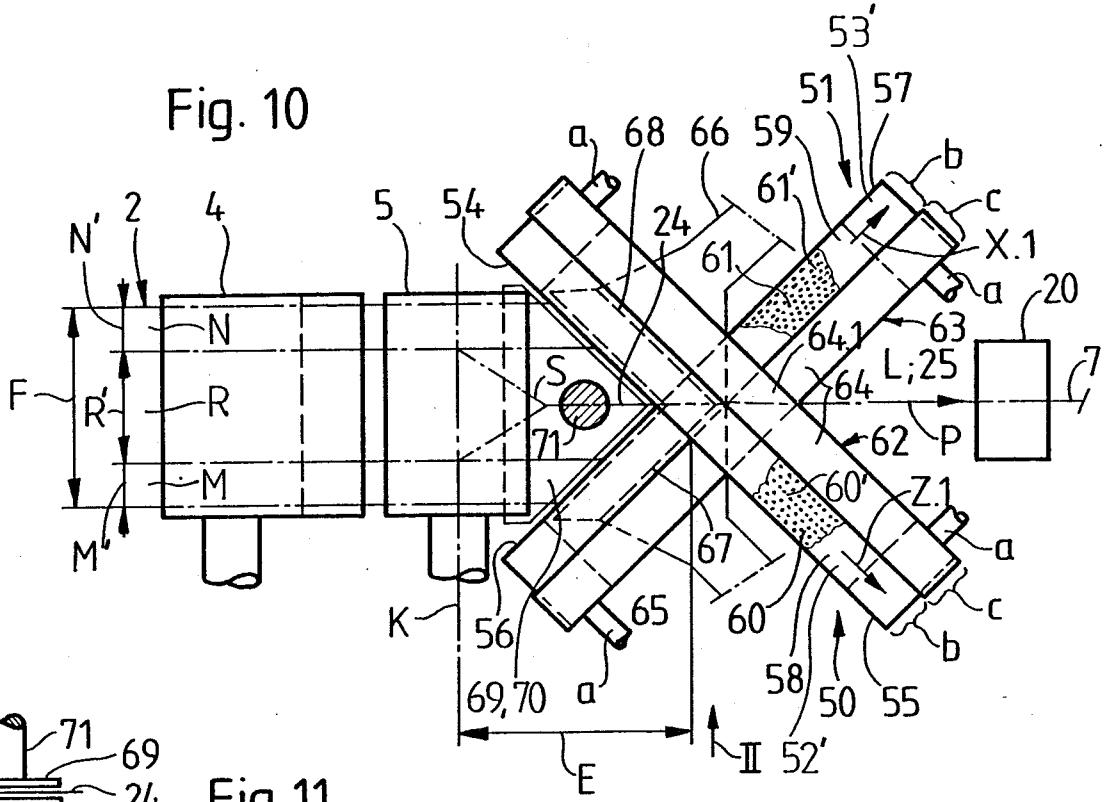
FIG. 10 is a schematic top plan view of the exemplary embodiment of false-twist spinning apparatus depicted in FIG. 9.
Figure 11:
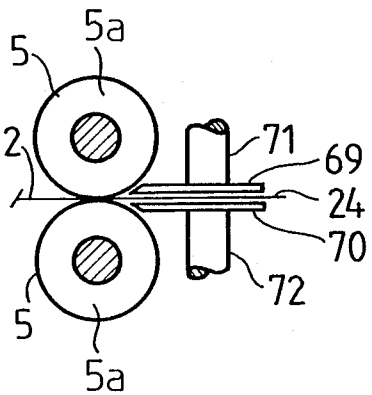
FIG. 11 shows a detail of the exemplary embodiment of false-twist spinning apparatus of FIGS. 9 to 10*a*, the view corresponding to the side elevational view shown in FIG. 9.

FIGS. 9 to 11 show a different embodiment of false-twist spinning apparatus or unit for performing the method according to the invention and using, instead of the spinning discs 8 and 9 of the arrangement of FIG. 1, two crossed spinning belts or aprons 50 and 51 here shown as substantially straight or linear belt members.

Each spinning belt or apron 50 and 51 of this so-called belt twister comprises a metal support band or belt 52 and 53, respectively, received on appropriately rotatably mounted deflecting or deflection rolls 54,55 and 56,57, respectively, and at least one such deflecting or deflection roll for each spinning belt or apron 50 and 51 must be driven by any suitable drive means as is well known in this technology. Therefore the spinning belt drive facilities and the rotatable mounting of the spinning belts or aprons 50 and 51 have merely been generally representatively indicated by the shaft journals a. Also for the sake of simplification of the showing of the drawings, the structure for disengaging at least one of the spinning belts or aprons from the other, has not been depicted.

Each metal support band or belt 52 and 53 is perforated over its width b to define a corresponding suction belt 52' and 53' and to form a respective suction surface 58 and 59 thereon. Some of the requisite apertures or openings 60 and 61 are shown at perforated regions 60' and 61', respectively, of these band or belts 52 and 53.

Disposed adjacent and parallel to the suction surfaces 58 and 59 is a respective friction belt or belt member 62 and 63, each such friction belt 62 and 63 having a related friction surface 64 on to which the associated metal support belt 52 and 53, respectively, is drawn in order to obviate slip between the metal support belt 52 or 53 and the respective associated friction belt 62 and 63. Each friction belt 62 and 63 has a width c, so that the width b of each suction surface 58 and 59 and the width c of the related friction belt 62 and 63, respectively, collectively make up the width of the corresponding metal support band or belt 52 and 53, respectively.

Figure 10A:
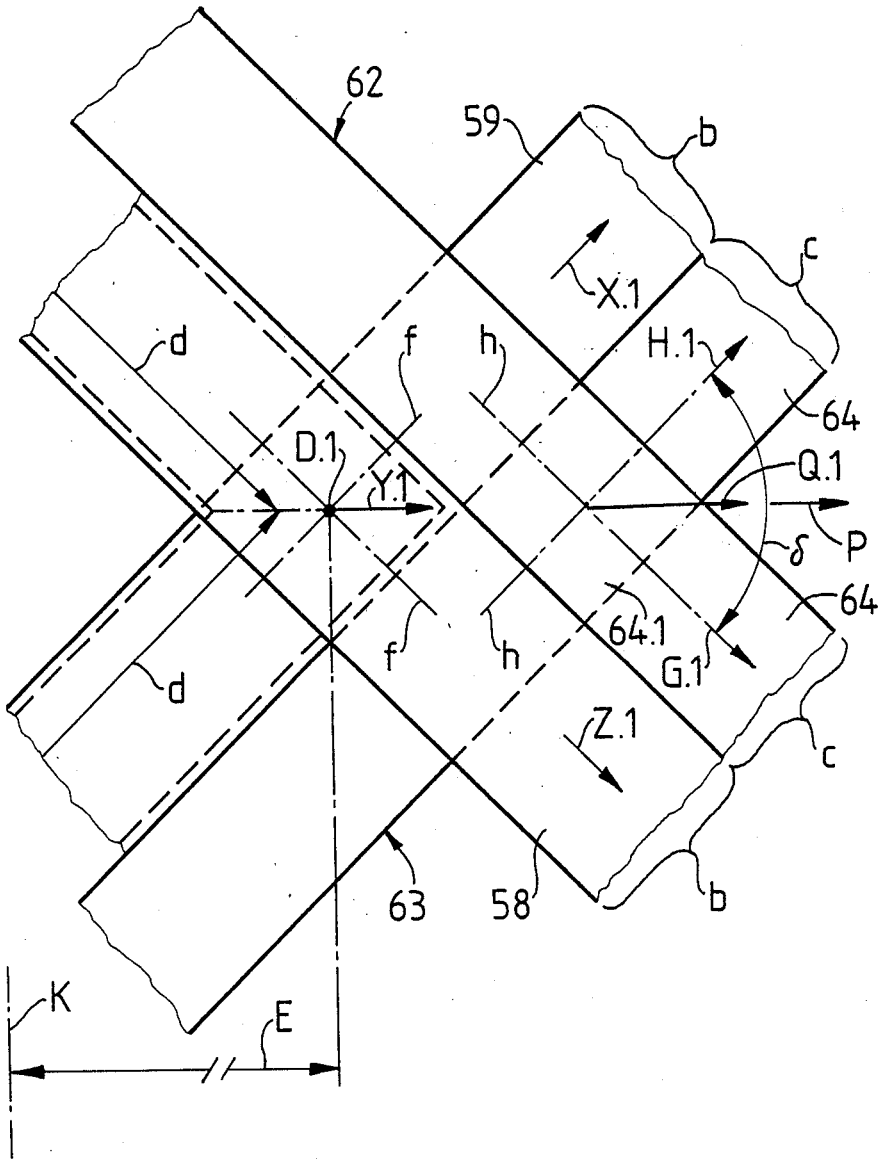
FIG. 10*a* is an enlarged view of a detail of the false-twist spinning apparatus or unit of FIGS. 9 and 10.

The friction belts or belt members 62 and 63 engage with one another virtually without clearance by way of their friction surfaces 64 and form, depending on the crossing angle $\delta$ (FIG. 10*a*) of the spinning belts or aprons 50 and 51, for instance, a rectangular or rhomboid overlap area or region 64.1.

The arithmetical total thickness of the friction belts 62 and 63, leads to the formation of a corresponding gap or space between the suction surfaces 58 and 59.

Figure 18A:
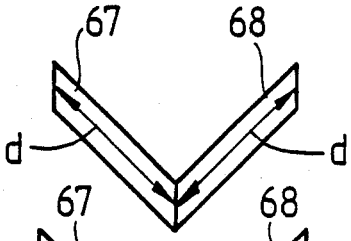
Figure 18B:
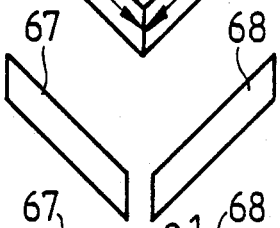
Figure 18C:
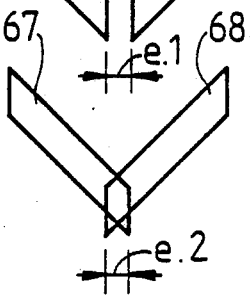

In order for air to be sucked through the suction surfaces 58 and 59, a suction nozzle 65 is provided within the spinning belt or apron 50 and a suction nozzle 66 within the spinning belt or belt or apron 51. The suction nozzle 65 has a suction inlet or mouth 67 and the suction nozzle 66 has a suction inlet or mouth 68, each such suction inlets 67 and 68 possessing a length d (FIGS. 18*a* to 18*c*).

The respective suction inlets 67 and 68 each have a width corresponding to the width of the perforated suction surface 58 and 59, respectively.

The suction inlets or mouths 67 and 68 are brought together or positioned, just as has been heretofore described for the suction nozzles 14 and 15 of the embodiment of FIGS. 1 to 3. Likewise, as was the case for the last-mentioned suction nozzles 14 and 15, here too, the suction inlets 67 and 68 of the suction nozzles 65 and 66, respectively, can be, when looking thereat in the plan view showing of FIG. 10, either contiguous with one another as in the arrangement of FIG. 18*a*, or can be spaced apart from one another by a distance e.1 as in the arrangement of FIG. 18*b* , or else can be arranged to overlap one another by an amount e.2 as in the arrangement of FIG. 18*c*.

In a manner analogous to the illustration of FIGS. 2 and 3, here too, there is a distance or spacing E between the nip line or nip K and the overlap area or region of the suction surfaces 58 and 59, shown concentrated together or represented by the imaginary intersection or intersection or crossing point D.1 of the center-lines f of the suction surfaces 58 and 59.

Also, as will be best seen by referring to FIG. 11, two fiber guiding or guide plates or plate members 69 and 70 or equivalent guide structure are provided between the crossed spinning belts or aprons 50 and 51 and guide all the fibers between the nip line or nip K and the suction surfaces 58 and 59.

As FIG. 10 shows, these fiber guiding or guide plates 69 and 70 are contiguous with or neighbor the respective suction surfaces 58 and 59 in order to guide the fibers delivered from the nip line or nip K very close to the suction surfaces 58 and 59.

The fiber guide plates 69 and 70 are mounted to be fixed or stationary during operation of the false-twist spinning apparatus or unit by means of supports or support elements 71 and 72 respectively, but, however, there may be provided any suitable facility for pivoting away these fiber guide plates 69 and 70 so that they can be cleaned.

Concerning the remaining structure it will be observed that as a matter of convenience the same reference numerals have been generally employed as previously used for the embodiment of FIGS. 1 to 3 heretofore described, to denote the same or analogous elements. The same observations are applicable as concerns the forces which arise at the overlap area or region 64.1 which, on the one hand, impart to the yarn core 24 the false twist and, on the other hand, the feed or forwarding movement thereof in the direction of yarn conveyance or movement P. These last-mentioned forces have been designated by reference characters H.1, G.1 and Q.1 in FIGS. 10 and 10*a* whereas the directions of feed or motion of the spinning belts or aprons 50 and 51 have been designated by reference characters Z.1 and X.1, respectively.

During operation, the fibers which are delivered to possess the fiber sliver width F from the nip line or nip K of the exit or delivery roll pair 5 comprising the rolls or rollers 5*a* are engaged by the suction surfaces 58 and 59 and guided between the fiber guiding plates 69 and 70. In a manner analogous to what has been previously described with reference to the embodiment of FIGS. 1 to 3, the intermediate fibers R form a yarn core which is twisted into a false-twisted yarn core 24 by means of the overlap area or region 64.1. Edge fibers M and N from the edge fiber zone are coiled or wrapped or twisted around the false-twisted yarn core 24 in the manner shown in FIGS. 4 to 6 and previously described.

Just as was the case for the embodiment of false-twist spinning apparatus or unit as shown and heretofore described with reference to FIGS. 1 to 3, here also the yarn core 24 untwists between the overlap area or region 64.1 and the not particularly referenced nip line or nip of the draw-off or withdrawal roll pair 20.

The distance E can be adapted with or without variation of the crossing angle $\delta$ of the spinning belts or aprons 50 and 51 with the resulting variation of the speed vector Q.

As to the remaining operation, the fibers behave in the manner heretofore described with reference to FIGS. 4 to 8, and therefore for the sake of brevity, it is unnecessary to again provide a corresponding description with reference to FIGS. 9 to 11.

Figure 12:
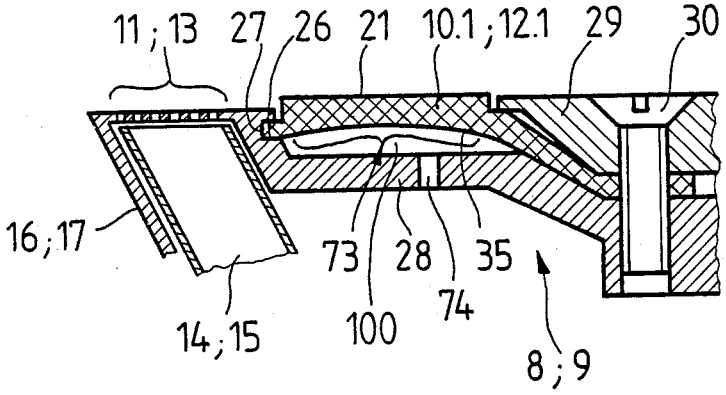
FIG. 12 is an enlarged sectional view of a detail of the exemplary embodiment of false-twist spinning apparatus depicted in FIGS. 1 to 3.

In FIG. 12 there is shown on an enlarged scale a portion of a modified construction of the spinning discs 8 and 9 of the prior described embodiment of FIG. 1 to 3 and such depicts a particular type of friction ring or ring member 10.1 and 12.1, respectively which, as illustrated in FIG. 12, is secured with a certain biasing or preloading. This biasing or preloading is produced by having the respective friction ring or ring member 10.1 or 12.1 engage in an associated groove or recess 27 by means of a projection or protuberance 26 provided on its outer circumference or surface. Each such groove or recess 27 is provided in the body or body member 28 of the related spinning disc or disc member 8 and 9. Also, each friction ring 10.1 and 12.1 is secured in the associated spinning disc or disc member 8 and 9 by means of a press-on or contact disc 29 and by a number of threaded bolts or screws 30 or the like arranged around the periphery of the corresponding spinning disc body or body member 28. Because of the biasing or preloading of each friction ring or ring member 10.1 and 12.1 the corresponding inner surface 35 thereof which is located opposite the related friction surface 21 has a bulge or domed portion or curvature 73 which is concave in the showing of FIG. 12. It is also here noted that the gap or space 100 which, when looking at FIG. 12 is located below the concave bulge or domed portion 73, is vented by a vent passage or port 74.

Moreover, the friction surface 21 was ground after the biasing or preloading of the associated friction ring or ring member 10.1 and 12.1 in order to provide a substantially flat or planar friction surface 21. The advantage of the aforenoted concavity provided by the bulge or domed portion 73 is that possible thick zones or enlarged regions present in the yarn core can be resiliently passed through by the aforedescribed construction of the friction rings or ring members 10.1 and 12.1.

Figure 13:
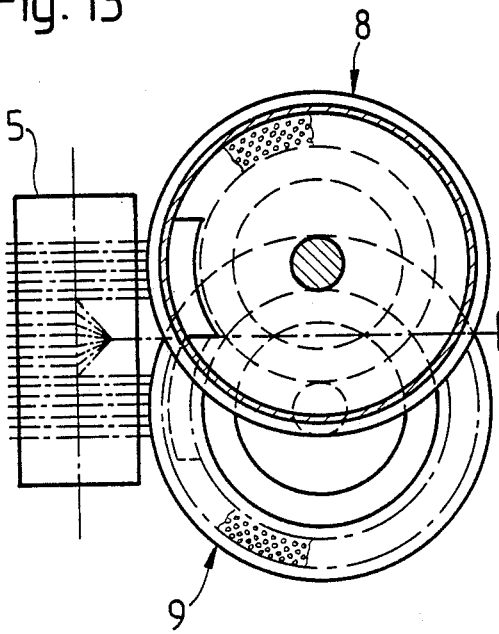
FIG. 13 shows a variant embodiment, depicted like in the showing of FIG. 2, of the exemplary embodiment of false-twist spinning apparatus or unit shown in FIGS. 1 to 3.
Figure 14:
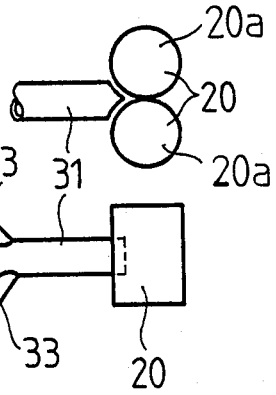
FIG. 14 is a fragmentary side view of a portion of the exemplary embodiment of false-twist spinning apparatus depicted in FIG. 13 showing a detail thereof at the region of the yarn withdrawal or draw-off roll pair.

In contrast to the embodiment of FIGS. 1 to 3, in the modified embodiment of FIGS. 13 and 14 a pneumatic conveying element or tube 31 is provided between the spinning discs 8 and 9 and the draw-off or withdrawal roll pair 20 and ensures that the yarn produced at the start-up of spinning is guided in the yarn direction of conveyance or movement P towards the draw-off or withdrawal roll pair 20. Just as would be the case for the embodiment of FIG. 1, here also at the start of spinning one of the two draw-off or withdrawal rolls 20*a* of the draw-off or withdrawal roll pair 20 is disengaged from the other in the direction indicated by the arrow k in FIG. 1 (see also FIG. 9) in order to enable the finished or spun yarn 7 and the air guiding the same to pass through between the draw-off or withdrawal rolls 20*a* of the draw-off or withdrawal roll pair 20.

In FIGS. 13 and 14 the pneumatic conveying element or tube 31 is shown as an injector tube, and there are provided two air supply tubes or elements 33 which supply air to the pneumatic conveying element or tube 31.

A pneumatic conveying element or tube 31 of the type shown in FIGS. 13 and 14 also can be used between the crossed spinning belts or aprons 50 and 51 and the draw-off or withdrawal roll pair 20.

Figure 15:
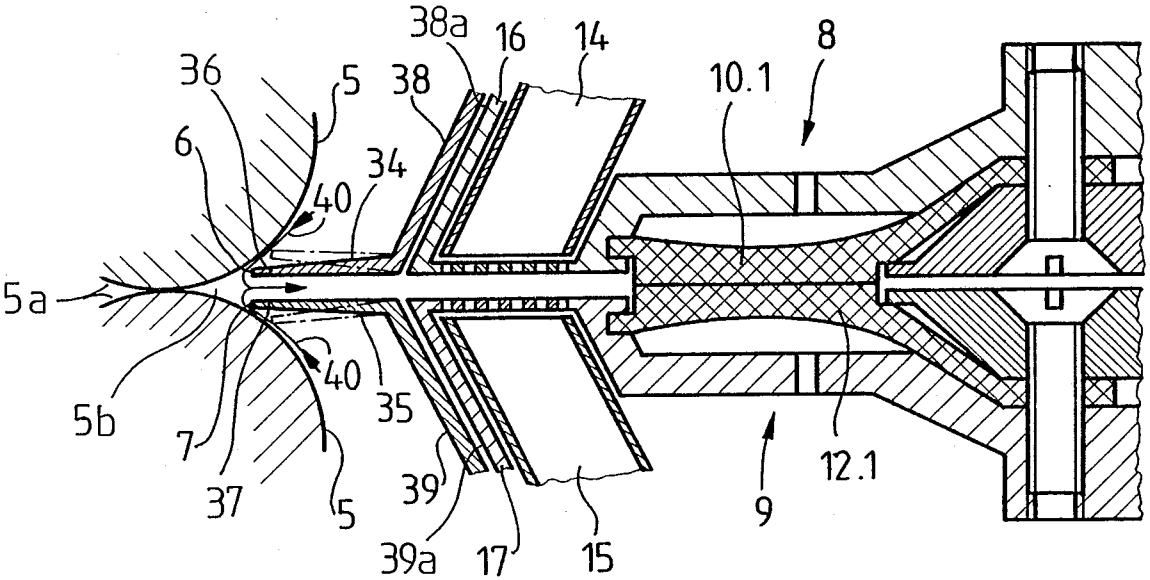
FIG. 15 illustrates, like in the showing of FIG. 12, a variant embodiment of the modification depicted in FIG. 12.

In the embodiment of FIG. 15 a fiber guiding plate or plate member 34 or equivalent structure is associated with the spinning disc 8 and a fiber guiding plate or plate member 35 or equivalent structure is associated with the spinning disc 9.

These fiber guiding plates 34 and 35 operate in the same way as the fiber guiding plates 69 and 70 heretofore described with reference to FIGS. 10 and 11.

The fiber guiding plate 34 has an inlet or mouth edge 36 and the fiber guiding plate 35 also has an inlet or mouth edge 37. These respective inlet edges 36 and 37 extend substantially parallel to the nip line or nip K. Moreover, the fiber guiding plate 34 is provided with a support member 38, for instance formed of sheet metal or plating, and the fiber guiding plate 35 is provided with a support member 39, likewise formed of, for instance, sheet metal or plating. These support members 38 and 39 enable the fiber guiding plates 34 and 35 to be fixedly mounted for operation in the position shown. An appropriate facility for conveniently removing these support members 38 and 39 to enable cleaning to be accomplished has not been shown, but any suitable structure can be used for this purpose.

The support members 38 and 39 are positioned at a slight spacing or gap 38*a* and 39*a*, respectively, of only a few tenths of a millimeter, from the associated cover walls or covers or enclosure members 16 and 17, respectively, and have at least the same width as the width A of the suction nozzles 14 and 15, respectively.

Additionally, it is noted that the inlet or mouth edges 36 and 37 extend only far enough into the divergent gap or space 5*b* between the rolls 5*a* of the exit roll pair 5 that an air flow, generally indicated by the arrows 40, between the inlet or mouth edges 36 and 37 and the rolls of the exit roll pair 5 can enter between the fiber guiding or guide plates 34 and 35.

Figure 16:
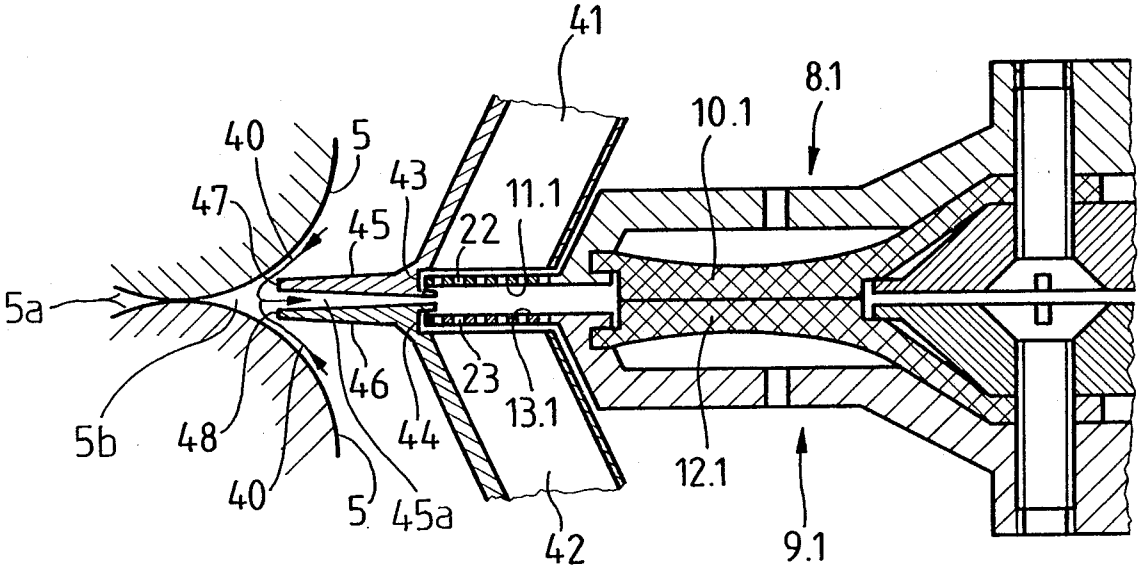
FIG. 16 illustrates, again like in the showing of FIG. 12, a further variant embodiment of the modification depicted in FIG. 12.

FIG. 16 shows a variant embodiment of the invention and depicts a modification of the spinning discs 8 and 9 in that here the spinning disc 8.1 and the spinning disc 9.1 are devoid of corresponding cover walls or covers 16 and 17 or the like. Instead of the omitted co-rotating cover walls or covers 16 and 17, the spinning disc 8.1, which is here shown located at the top when looking at the illustration of FIG. 16, has a top or upper suction nozzle 41 and the other, here then the bottom or lower spinning disc 9.1 has a bottom or lower suction nozzle 42. These suction nozzles 41 and 42 are appropriately fixedly mounted for operation but can be removed for cleaning as has been previously explained.

The annular or ring-shaped parts or portions of the spinning discs 8.1 and 9.1, and which annular disc parts or portions form the respective suction surfaces 11.1 and 13.1 and are formed with the apertures or openings 22 and 23, respectively, extend at their outermost zone, in the manner shown in FIG. 16, into grooves or recesses 43 and 44 provided in the respective suction nozzles 41 and 42.

Also, these suction nozzles 41 and 42 have connected thereto respective fiber guiding plates 45 and 46 whose inlet or mouth edges or portions 47 and 48 extend only far enough into the divergent gap or space 5*b* between the pair of exit or withdrawal rolls 5*a* for the air flow 40 to enter between the inlet or mouth edges 47 and 48 and the exit or withdrawal roll pair 5 into the space or region 45*a* between the fiber guiding plates 45 and 46.

While there are shown and described present preferred embodiments of the invention, it is to be distinctly understood that the invention is not limited thereto, but may be otherwise variously embodied and practiced within the scope of the following claims. ACCORDINGLY,

What is claim is:

1. A method of false-twist spinning or yarn, comprising the steps of:

delivering a fiber sliver in a predeterminate sliver width from a sliver feeder having a pair of exit rolls forming a nip line for movement of the fiber sliver in a predetermined direction of conveyance;

engaging by suction means ends of fibers of the fiber sliver which constitute front fiber ends, as viewed in the predetermined direction of conveyance of the fiber sliver;

the step of engaging by the suction means the ends of the fibers of the fiber sliver entailing moving two suction surfaces of the suction means in opposite directions for suctionly engaging predominantly all of the fibers of the fiber sliver and conveying on the suction surfaces the thus suctionly engaged fibers towards one another for commingling the suctionly engaged fibers with one another and for conveyance of said suctionly engaged fibers in said predetermined direction of conveyance;

supplying an inner portion of the engaged fibers to fiber twisting means arranged downstream of the suction means, as viewed from the location of the sliver feeder in the predetermined direction of conveyance of the fiber sliver;

forming at the fiber twisting means a false-twisted yarn core from said inner portion of the engaged fibers which are twisted to be wound at predeterminate pitch;

utilizing as the fiber twisting means two oppositely movable friction surfaces with which merge associated ones of the suction surfaces as viewed in said predetermined direction of conveyance;

supplying by means of said suction means at least outer portions of said fiber sliver as edge fibers to said false-twisted yarn core such that said edge fibers are wound by said fiber twisting means around the false-twisted yarn core with a pitch steeper than the predeterminate pitch of the wound fibers of said false-twisted yarn core in order to produce a yarn travelling in a predetermined direction of movement; and selecting a distance between the nip line of the eit rolls of the sliver feeder and an imaginary predeterminate intersection of the suction surfaces to be in such a relationship to an average fiber length of the fibers of the fiber sliver that the false-twisted yarn core engages the edge fibers at their front ends as long as rear ends thereof remain clamped in the nip line, so that the edge fibers leave the nip line only after the edge fibers have been twisted around the yarn core and are engaged by a spinning triangle formed by the inner portion of the engaged fibers twisted to form said false-twisted yarn core.

2. The method as defined in claim 1, further including the step of:

determining the predeterminate sliver width of said fiber sliver by means of a condenser.

3. The method as defined in claim 1, further including the step of:

moving said movable suction surfaces towards one another such that said movable suction surfaces overlap one another at a predeterminate overlap location, as viewed looking upon said movable suction surfaces, and such that the directions of movement of said movable suction surfaces at said predeterminate overlap location produce a substantially common force direction which serves to feed said fibers conveyed on said suction surfaces to said fiber twisting means.

4. The method as defined in claim 3, further including the step of:

using as each suction surface a rotating annular surface and the directions of movement of the rotating annular surfaces, expressed as vectors, make substantially tangential contact with center lines of said suction surfaces at a point of intersection of said center lines with one another corresponding to said imaginary predeterminate intersection of said suction surfaces.

5. The method as defined in claim 1, further including the step of:

moving said two friction surfaces in opposite directions with respect to one another and towards one another at a predeterminate crossing region of the two friction surfaces so as to produce at said predeterminate crossing region a substantially common force direction in said predetermined direction of movement of the yarn sufficient to produce in said false-twisted yarn core a tension imparting a predeterminate width to the spinning triangle formed by the inner portion of the engaged fibers twisted to form said false-twisted yarn core.

6. The method as defined in claim 5, further including the step of:

using as each friction surface an annular surface rotating around a center thereof and said directions of movement of the friction surfaces, expressed as vectors, make contact with center lines of said friction surfaces at an imaginary point of intersection of said center lines with one another.

7. The method as defined in claim 5, further including the step of:

using as each friction surface a substantially straight movable endless belt and said directions of movement of the friction surfaces, expressed as vectors, extend in center lines of each endless belt away from a point of intersection of said center lines.

8. The method as defined in claim 1, further including the step of:

using as each friction surface a substantially straight movable endless belt and said directions of movement of the friction surfaces, expressed as vectors, extend in center lines of each endless belt away from a point of intersection of said center lines.

9. The method as defined in claim 1, further including the steps of:

using as the sliver feeder a drafting arrangement for drafting of the fiber sliver;

the inner portion of the engaged fibers twisted to form said false-twisted yarn core form as the spinning triangle a spinning triangle having a predeterminate width; and the predeterminate sliver width of said drafted fiber sliver is 10% to 30% greater than the predeterminate width of said spinning triangle.

10. The method as defined in claim 1, further including the steps of:

engaging the yarn formed by the fiber twisting means as said yarn travels in said predetermined direction of movement by a yarn conveying means; and transferring the thus engaged yarn to a pair of withdrawal rolls.

11. A method of false-twist spinning a yarn, comprising the steps of:

delivering a fiber sliver in a predeterminate sliver width from a sliver feeder forming a nip line for movement of the fiber sliver in a predetermined direction of conveyance;

engaging by suction means ends of fibers of the fiber sliver which constitute front fiber ends, as viewed in the predetermined direction of conveyance of the fiber sliver;

the step of engaging by the suction means the ends of the fibers of the fiber sliver entailing moving two suction surfaces of the suction means in predetermined directions for suctionly engaging the fibers of the fiber sliver and conveying on the suction surfaces the thus suctionly engaged fibers in said predetermined direction of conveyance;

supplying an inner portion of the engaged fibers to fiber twisting means;

forming at the fiber twisting means a false-twisted yarn core from said inner portion of the engaged fibers which are twisted at predeterminate pitch;

supplying by means of suction means at least outer portions of said fiber sliver as edge fibers to said false-twisted yarn core such that said edge fibers are twisted by said fiber twisting means around the false-twisted yarn core with a pitch steeper than the pitch of the twisted fibers forming said false-twisted yarn core in order to produce a yarn travelling in a predetermined direction of movement; and selecting a distance between the nip line of the sliver feeder and an imaginary predeterminate crossing of the suction surfaces to be in such a relationship to an average fiber length of the fibers of the fiber sliver that the false-twisted yarn core engages the edge fibers at their front ends as long as rear ends thereof remain clamped in the nip line so that the edge fibers leave the nip line only after the edge fibers have been twisted around the yarn core and are engaged by a spinning triangle formed by the inner portion of the engaged fibers twisted to form said false-twisted yarn core.

12. A method of false-twist spinning a yarn, comprising the steps of:

delivering a fiber sliver in a predeterminate sliver width from a sliver feeder forming a nip line for movement of the fiber sliver in a predetermined direction of conveyance;

engaging by suction means ends of fibers of the fiber sliver which constitute front fiber ends, as viewed in the predetermined direction of conveyance of the fiber sliver;

the step of engaging by the suction means the ends of the fibers of the fiber sliver entailing moving two suction surfaces of the suction means in directions for suctionly engaging the fibers of the fiber sliver and for conveying the thus suctionly engaged fibers in a direction for commingling the suctionly engaged fibers with one another and for conveyance of said suctionly engaged fibers in said predetermined direction of conveyance;

supplying an inner portion of the engaged fibers to mechanical fiber twisting means;

forming at the mechanical false twisting means a false-twisted yarn core from said inner portion of the engaged fibers which are twisted to be wound at predeterminate pitch;

supplying by means of said suction means at least outer portions of said fiber sliver as edge fibers to said false-twisted yarn core such that said edge fibers are twisted by said mechanical fiber twisting means around the false-twisted yarn core with a pitch steeper than the pitch of the twisted fibers forming said false-twisted yarn core in order to produce a yarn travelling in a predetermined direction of movement; and selecting a distance between the nip line of the sliver feeder and an imaginary predeterminate intersection of the suction surfaces be in such a relationship to an average fiber length of the fibers of the fiber sliver that the false-twisted yarn core engages the edge fibers at their front ends as long as rear ends thereof remain clamped in the nip line, so that the edge fibers leave the nip line only after the edge fibers have been twisted around the yarn core and are engaged by a spinning triangle formed by the inner portion of the engaged fibers twisted to form said false-twisted yarn core.

13. An apparatus for false-twist spinning a yarn, comprising:

fiber sliver feeder means defining a nip line;

said fiber sliver feeder means delivering a fiber sliver in a predeterminate width from said nip line;

spinning means for spinning said fiber sliver into a yarn;

said spinning means comprising:

suction means for engaging and conveying fiber ends of the fiber sliver delivered by said fiber sliver feeder means and thus forwarding the fibers engaged at said fiber ends, said fiber ends being front ends of the fiber sliver as viewed in a predetermined direction of movement of the fibers of the fiber sliver;

said suction means comprising two perforate suction surfaces arranged opposite one another;

said two perforate suction surfaces being movable in directions towards one another and overlapping one another;

twisting means for twisting a portion of said fibers of the fiber sliver delivered by said suction means into a false-twisted yarn core;

said twisting means comprise two friction surfaces;

a respective one of the suction surfaces and a respective one of said friction surfaces being disposed adjacent one another and arranged for movement in the same direction;

each said respective suction surface being disposed before said friction surface at least at the region of said fiber sliver feeder means as considered in said predetermined direction of movement; and means for drawing-off the spun yarn in a predetermined direction of yarn movement.

14. The apparatus as defined in claim 13, further including:

means for conjointly driving each said respective suction surface and said respective friction surface disposed adjacent one another.

15. The apparatus as defined in claim 13, further including:

a fiber guiding element provided between said fiber sliver feeder means and said spinning means; and said fiber guiding element serving for guiding said fibers of said fiber sliver between said nip line and said spinning means.

16. The apparatus as defined in claim 13, wherein:

each said respective suction surface and said respective friction surface disposed adjacent one another define interconnected surfaces.

17. The apparatus as defined in claim 16, wherein:

said spinning means comprising a pair of coacting discs;

each of said discs of said pair of coacting discs having a predetermined axis of rotation;

the predetermined axis of rotation of one of the discs being spaced from the predetermined axis of rotation of the other one of said discs at a predeterminate inter-axis distance;

said pair of coacting discs being arranged in offset relationship transversely with respect to said predetermined direction of yarn movement;

each of said discs being provided with one of said suction surfaces and one of said friction surfaces;

each of said suction surfaces having a center line;

the suction surfaces of said discs crossing one another at the center lines to define an imaginary intersection point;

said imaginary intersection point possessing a predeterminate distance from the nip line;

velocity vectors of said suction surfaces extending away from said imaginary intersection point defining a common component in the predetermined direction of movement of the yarn;

each of said friction surfaces having a center line;

the friction surfaces of the discs crossing one another at the center lines thereof to define an imaginary intersection point;

said friction surfaces possessing a common force component extending from said imaginary intersection point in the predetermined direction of movement of the yarn; and said discs being arranged so as to diverge in the predetermined direction of movement of the yarn such that only a crossing area of the discs and which is situated closest to the nip line generates the common force component in the predetermined direction of movement of the yarn.

18. The apparatus as defined in claim 17, further including:

a pneumatic conveying means provided between said spinning means and said means for drawing-off the spun yarn; and said pneumatic conveying means serving for conveying said spun yarn from said spinning means to said means for drawing-off said spun yarn.

19. The apparatus as defined in claim 16, wherein:

said suction means and said twisting means comprise a pair of drivable spinning discs each rotatable about a predetermined axis of rotation;

each said respective one of said suction surfaces and said respective one of said friction surfaces which are disposed adjacent one another and arranged for movement in the same direction being provided on a respective one of said spinning discs of said pair of drivable spinning discs;

each said suction surface defining a respective annular surface;

each said friction surface defining a respective annular surface;

each said respective one of said suction surfaces and said respective one of said friction surfaces which are disposed adjacent one another and arranged for movement in the same direction having said friction surface disposed inside said suction surface; and said friction surface protruding in relation to the adjacent suction surface.

20. The apparatus as defined in claim 19, wherein:

each said adjacently arranged suction surface and said friction surface are coaxially arranged with respect to one another.

21. The apparatus as defined in claim 19, wherein:

each said friction surface is defined by a friction ring; and each said friction ring being resiliently structured in a direction transverse to a yarn axis extending in said predetermined direction of yarn movement.

22. The apparatus as defined in claim 16, wherein:

said spinning means comprise a pair of coacting endless drivable spinning belts;

a respective one of the suction surfaces and a respective one of the friction surfaces being provided at each spinning belt of said pair of coacting endless drivable spinning belts;

each of said spinning belts of said pair of coacting endless drivable spinning belts comprising a suction belt provided with an associated one of said perforate suction surfaces;

each said suction belt extending over a predeterminate portion of the width of the associated spinning belt;

each of said spinning belts of said pair of coacting spinning belts further comprising a friction belt provided with an associated one of said friction surfaces;

each said friction belt extending substantially over the remaining width of the associated spinning belt;

each spinning belt having said friction surface arranged after the suction surface as viewed in the predeterminate direction of movement of the fibers of the fiber sliver; and each said suction surface protruding beyond the friction surface of the associated spinning belt.

23. The apparatus as defined in claim 22, wherein:

said suction surface and said friction surface of each spinning belt are disposed immediately adjacent one another.

24. The apparatus as defined in claim 23, further including:

a pneumatic conveying means provided between said spinning means and said means for drawing-off the spun yarn; and said pneumatic conveying means serving for conveying said spun yarn from said spinning means to said means for drawing-off said spun yarn

25. The apparatus as defined in claim 22, wherein:

each of said belts of said pair of coacting endless drivable spinning belts being arranged opposite one another and in crossing relationship with respect to one another;

said suction surfaces each having a center line;

said center lines of said suction surfaces crossing at a predeterminate imaginary intersection point;

said predeterminate imaginary intersection point of said center lines possessing a predeterminate spacing from the nip line;

velocity vectors of the suction surfaces defining an essentially common component in the predetermined direction of movement of the yarn; and said friction surfaces crossing one another and defining a common force component in the predetermined direction of movement of the yarn.

26. An apparatus for false-twist spinning a yarn, comprising:

a fiber sliver feeder means defining a nip line;

said fiber sliver feeder means delivering a fiber sliver in a predeterminate width from said nip line;

spinning means for spinning said fiber sliver into a spun yarn;

said spinning means comprising:

suction means for engaging and conveying fiber ends of the fiber sliver delivered by said fiber sliver feeder means, said fiber ends being front ends of the fiber sliver as viewed in a predetermined direction of movement of the fibers of the fiber sliver;

said suction means comprising two movable suction surfaces arranged in coacting fiber engaging relationship;

mechanical twisting means for twisting a portion of said fibers of the fiber sliver delivered by said suction means into a false-twisted yarn core and for twisting a further portion of the fibers of the fiber sliver around the false-twisted yarn core in order to form the spun yarn;

said mechanical twisting means comprising two friction surfaces defining a twisting region for twisting the fibers of the fiber sliver in order to form the spun yarn;

a respective one of the suction surfaces and a respective one of said friction surfaces being disposed in neighboring relationship and moving in the same direction;

each said respective suction surface being disposed upstream of said neighboring friction surface at said twisting region as considered in said predetermined direction of movement; and means for drawing-off the spun yarn in a predetermined direction of yarn movement.

* * * * *

UNITED STATES PATENT AND TRADEMARK OFFICE

CERTIFICATE OF CORRECTION

PATENT NO. : 4,823,545

DATED : April 25, 1989

INVENTOR(S) : HANS FLUECKIGER

It is certified that error appears in the above-identified patent and that said Letters Patent is hereby corrected as shown below:

Column 1, line 8, after "present" please insert --development as employed for the practice of the inventive--

Column 3, line 63, after "the" (first occurrence) please delete "silver" and insert --sliver--

Column 7, line 20, after "or" please insert --sliver condensers, for example, the condenser 32, that the--

Column 14, line 15, after "What" please delete "is" (first occurrence) and insert --I--

Column 17, line 25, after "surfaces" please insert --to--

Signed and Sealed this

Nineteenth Day of December, 1989

*Attest:*

JEFFREY M. SAMUELS

*Attesting Officer* *Acting Commissioner of Patents and Trademarks*